US007604492B1

(12) United States Patent
Wang

(10) Patent No.: US 7,604,492 B1
(45) Date of Patent: Oct. 20, 2009

(54) POWER SUPPLY ADAPTER

(75) Inventor: Ke-Guan Wang, Taipei Hsien (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 12/275,527

(22) Filed: Nov. 21, 2008

(51) Int. Cl.
*H01R 13/44* (2006.01)

(52) U.S. Cl. ..... 439/131

(58) Field of Classification Search ..... 439/131
See application file for complete search history.

(56) References Cited

U.S. PATENT DOCUMENTS 4,794,315 A * 12/1988 Pederson et al. ..... 320/111
4,997,381 A * 3/1991 Oh ..... 439/172
5,006,779 A * 4/1991 Fenne et al. ..... 320/111
5,611,701 A * 3/1997 Hahn ..... 439/131
5,613,863 A * 3/1997 Klaus et al. ..... 439/131
5,628,641 A * 5/1997 Hahn ..... 439/131
5,791,921 A * 8/1998 Lee ..... 439/172
5,829,993 A * 11/1998 Wu ..... 439/131
5,967,807 A * 10/1999 Wu ..... 439/131
6,126,460 A * 10/2000 Wu ..... 439/131
6,312,271 B1 * 11/2001 Tseng ..... 439/131
6,398,566 B1 * 6/2002 Chen ..... 439/131
6,454,578 B1 * 9/2002 Yao ..... 439/131
6,780,033 B2 * 8/2004 Liu ..... 439/172
6,790,062 B1 * 9/2004 Liao ..... 439/171
6,793,509 B2 * 9/2004 Chen ..... 439/136
6,935,878 B2 * 8/2005 Hsu et al. ..... 439/171
6,939,150 B1 * 9/2005 Lanni ..... 439/131
7,001,196 B1 * 2/2006 Huang ..... 439/320
7,354,286 B1 * 4/2008 Lee ..... 439/172
7,503,779 B1 * 3/2009 Yang et al. ..... 439/131
7,549,877 B1 * 6/2009 Vista et al. ..... 439/172
2002/0151199 A1 * 10/2002 Yao ..... 439/131
2002/0173183 A1 * 11/2002 Segawa et al. ..... 439/131
2004/0038572 A1 * 2/2004 Liu ..... 439/172
2004/0209499 A1 * 10/2004 Chung ..... 439/131

* cited by examiner

*Primary Examiner*—Ross N Gushi
(74) *Attorney, Agent, or Firm*—WPAT, P.C.; Anthony King

(57) ABSTRACT

A power supply adapter includes a base frame, a pin assembly having a first pin defining a first fixing portion and a second pin respectively pivoted in the base frame, a driving module having a control element pivoted on the base frame and a connecting bar pivoted between the first pin and the second pin. The control element has a pressing portion, a propping portion extended from the pressing portion and a second fixing portion protruding from the propping portion. The second fixing portion can be buckled with the first fixing portion to secure the pin assembly in the base frame by way of pushing the first pin to drive the pin assembly by means of the connecting bar to rotate into the base frame, while the pressing portion can be pressed to make the second fixing portion release the first fixing portion so as to make the pin assembly extend out of the base frame.

9 Claims, 5 Drawing Sheets

POWER SUPPLY ADAPTER

BACKGROUND OF THE INVENTION

1. Field of the Invention

The present invention generally relates to a power supply adapter, and more particularly to a power supply adapter with a foldable pin assembly.

2. The Related Art

A conventional power supply adapter includes a base frame, a first pin, two second pins and a driving module disposed in the base frame respectively. The driving module includes a driving portion and three connecting bars. One end of one of the three connecting bars is connected with the driving portion and the other end thereof is pivoted to the first pin. The other two connecting bars are respectively pivoted between the first pin and the corresponding second pins. The driving portion is movably disposed on the base frame.

When the power supply adapter is not in use, the user pushes the driving portion to move and further to drive the connecting bar between the driving portion and the first pin to move. In the meanwhile, the connecting bar drives the first pin to rotate into the base frame. In this process, the two connecting bars between the first pin and the second pins are driven by the first pin to move and further drive the corresponding second pins to rotate into the base frame.

When the power supply adapter is in use, the user pushes the driving portion back to drive the connecting bar between the driving portion and the first pin to move back. In the meanwhile, the connecting bar drives the first pin to rotate out of the base frame. In this process, the two connecting bars between the first pin and the second pins are driven by the first pin to move back and further drive the corresponding second pins to rotate out of the base frame.

However, the conventional power supply adapter utilizes the driving portion to drive the connecting bars and further drive the pins to either rotate into the base frame to be stowed or rotate out of the base frame to be used such that makes the driving module have a relatively complicated structure and occupy a relatively large space in the power supply adapter.

SUMMARY OF THE INVENTION

An object of the present invention is to provide a power supply adapter. The power supply adapter includes a base frame, a pin assembly having a first pin and at least one second pin respectively pivoted in the base frame, a driving module having a control element and at least one connecting bar, and a shell covered on the base frame. The first pin defines a first fixing portion. The control element is pivoted on the base frame and has a pressing portion, a propping portion extended from the pressing portion and a second fixing portion protruding from a free end of the propping portion. The connecting bar is pivoted between the first pin and the second pin. The shell defines a receiving window for receiving the pressing portion of the control element therein. The pressing portion partially stretches out of the receiving window. Wherein the second fixing portion of the control element is capable of being buckled with the first fixing portion of the first pin so as to secure the pin assembly in the base frame by way of pushing the first pin to drive the pin assembly by means of the connecting bar to rotate into the base frame, while the pressing portion of the control element can be pressed to make the second fixing portion release the first fixing portion so as to make the pin assembly extend out of the base frame.

As described above, the above-mentioned power supply adapter utilizes a cooperation of the first fixing portion of the first pin and the second fixing portion of the control element by means of pushing the first pin to facilitate the pin assembly to be stowed in the base frame or by means of pressing the pressing portion of the control element to facilitate the pin assembly to be extended out of the base frame. Therefore, the driving module has a relatively simple structure and occupies a relatively small space in the power supply adapter.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
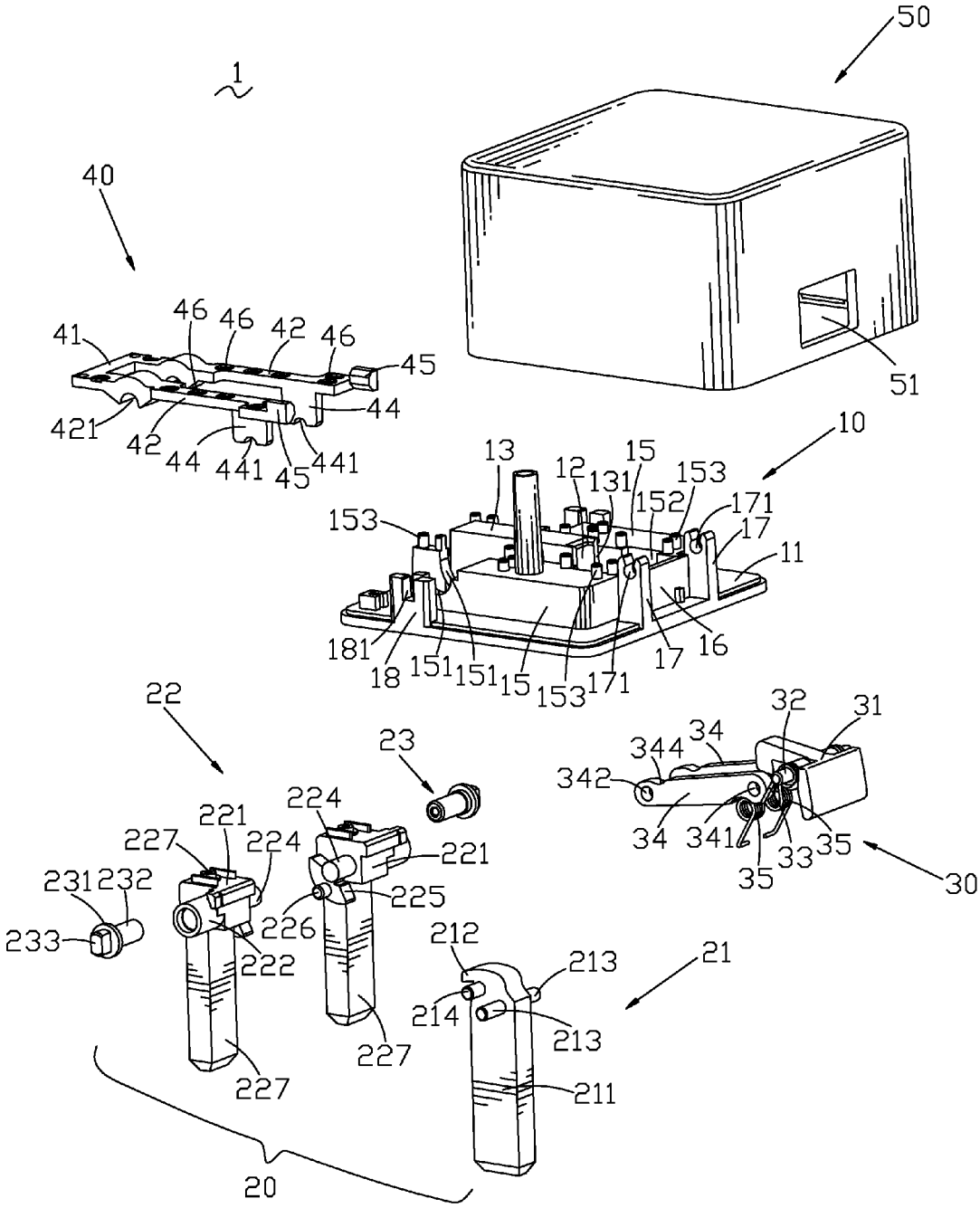
FIG. 1 is an exploded perspective view of a power supply adapter in accordance with the present invention.

With reference to FIG. 1, a power supply adapter 1 according to the present invention includes a base frame 10, a pin assembly 20, a driving module 30, a fastening body 40 and a shell 50.

Figure 2:
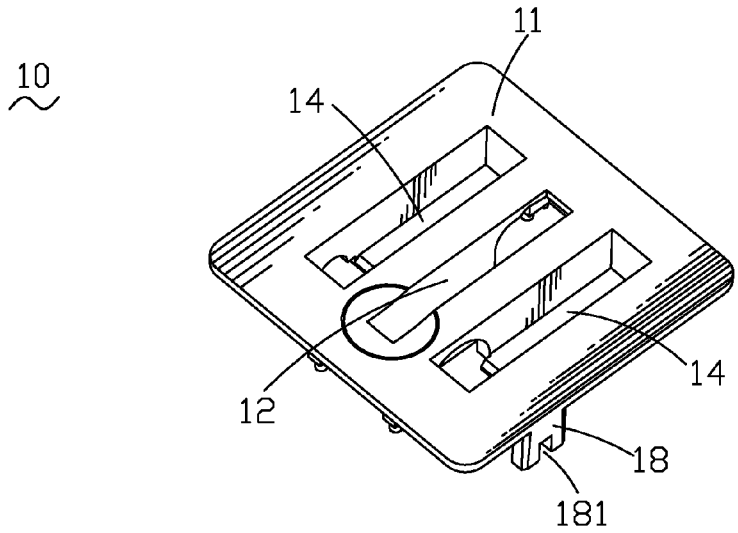
FIG. 2 is a perspective view of a base frame of the power supply adapter of FIG. 1.

Referring to FIG. 1 and FIG. 2, the base frame 10 has a rectangular base board 11 disposed levelly. A middle of the base board 11 protrudes upwards to form a rectangular hollow first receiving casing 13 extending longitudinally and having a front opened freely. The first receiving casing 13 defines a rectangular first receiving recess 12 therein having a bottom passing through the base board 11. A front of each side of the first receiving casing 13 is concaved downwards to form a first pivoting cavity 131 passing therethrough and communicating with the first receiving recess 12. The base board 11 further protrudes upwards to form two rectangular hollow second receiving casings 15 located at two sides of the first receiving casing 13 and respectively paralleling the first receiving casing 13. Each second receiving casing 15 has a rear opened freely and defines a rectangular second receiving recess 14 therein having a bottom passing through the base board 11. A rear of each side of the second receiving casing 15 is concaved downwards to form a second pivoting cavity 151 passing therethrough and communicating with the second receiving recess 14. The side of each second receiving casing 15 facing the first receiving casing 13 defines a substantially rectangular fastening fillister 152 facing the corresponding first pivoting cavity 131. A top of each second receiving casing 15 protrudes upwards to form a plurality of fastening pillars 153. A front of the base board 11 protrudes upwards to form a preventing board 16 extending transversely to connect with the two second receiving casings 15 and located in front of the first receiving casing 13. The front of the base board 11 further protrudes upwards to form a pair of supporting boards 17 connected with two ends of the preventing board 16 and extending longitudinally to face each other. A top of each supporting board 17 defines a pivoting hole 171 transversely passing therethrough. Two opposite sides of the base board 11 protrude upwards to form two fastening boards 18 at rear. A middle of a top of each fastening board 18 defines a rectangular fastening cavity 181 transversely passing therethrough and facing the corresponding second pivoting cavity 151.

Referring to FIG. 1 again, the pin assembly 20 includes a first pin 21, two second pins 22 and two locating elements 23 respectively pivoted in the second pins 22. The first pin 21 has a rectangular first blade 211 disposed vertically. A top of the first blade 211 protrudes rearward to form a first fixing portion 212. Two opposite sides of the top of the first blade 211 oppositely protrude sideward to form a pair of first pivoting pillars 214 at rear and a pair of first pivoting shafts 213 at front. The first pivoting shafts 213 are lower than the corresponding first pivoting pillars 214. Each of the second pins 22 has a rectangular base block 221 and a rectangular second blade 227. The second blade 227 is disposed vertically and has a top fixed in the base block 221 and stretching out of a top of the base block 221. One side of the base block 221 protrudes sideward to form a cylindrical pivoting tube 222 at front. The other side of the base block 221 protrudes sideward to form a second pivoting shaft 224 coaxial with the pivoting tube 222 and further form a substantially fan-shaped locating portion 225 at rear located under the second pivoting shaft 224. A substantial middle of the locating portion 225 protrudes sideward to form a second pivoting pillar 226. Each of the locating elements 23 has a disc-shaped propping slice 231 disposed vertically. Two opposite sides of the propping slice 231 protrude oppositely to form a third pivoting shaft 232 and a substantially rectangular fastening portion 233.

Figure 3:
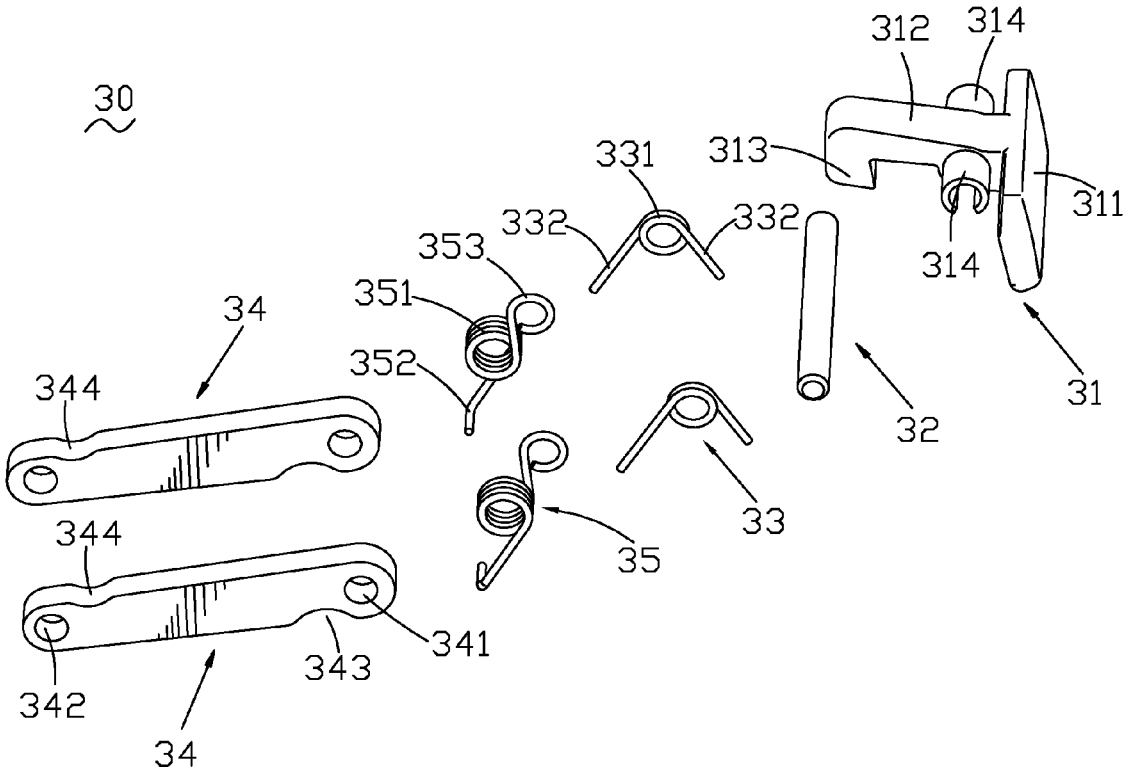
FIG. 3 is an exploded perspective view of a driving module of the power supply adapter of FIG. 1.

Referring to FIG. 1 and FIG. 3, the driving module 30 includes a control element 31, a columned pivoting bar 32, two first springs 33, two connecting bars 34 and two second springs 35. The control element 31 has a rectangular pressing portion 311 disposed vertically. A middle of a top of the pressing portion 311 extends rearward to form a propping portion 312 slightly inclined upwards. A rear end of the propping portion 312 protrudes downwards to form a second fixing portion 313 and two sides of a front thereof oppositely protrude sideward to form two cylindrical pivoting sleeves 314 adjacent to a rear of the pressing portion 311. Each of the first springs 33 has a first sleeving portion 331. Two free ends of the first sleeving portion 331 oppositely extend outward and incline downwards to form two propping poles 332. Each connecting bar 34 is substantially rectangular and extends longitudinally. A front of the connecting bar 34 defines a first pivoting aperture 341 transversely passing therethrough and a rear thereof defines a second pivoting aperture 342 transversely passing therethrough. A bottom side of the connecting bar 34 defines a first receiving groove 343 adjacent to the first pivoting aperture 341 and a top side thereof defines a second receiving groove 344 adjacent to the second pivoting aperture 342. Each second spring 35 has a second sleeving portion 351. One free end of the second sleeving portion 351 extends upwards and then is bent to form a circular fastening ring 353, and the other free end thereof extends downwards and inclines toward the second sleeving portion 351, and then is bent to form a propping part 352.

Referring to FIG. 1 again, the fastening body 40 has a rectangular base plate 41 extending transversely. Two opposite ends of the base plate 41 extend forward to form a pair of first fastening plates 42. A rear of a bottom of each first fastening plate 42 defines an arched first fastening groove 421 transversely passing therethrough. An inside of the first fastening plate 42 protrudes downwards to form a second fastening plate 44 at front. A bottom of the second fastening plate 44 defines an arched second fastening groove 441 transversely passing therethrough. An outside of a front end of the first fastening plate 42 protrudes forward to form a fastening block 45. The first fastening plate 42 further defines a plurality of fastening perforations 46 vertically passing therethrough. The shell 50 is of a rectangular hollow shape and has a bottom opened freely. A front side of the shell 50 defines a rectangular receiving window 51 passing therethrough.

Figure 4:
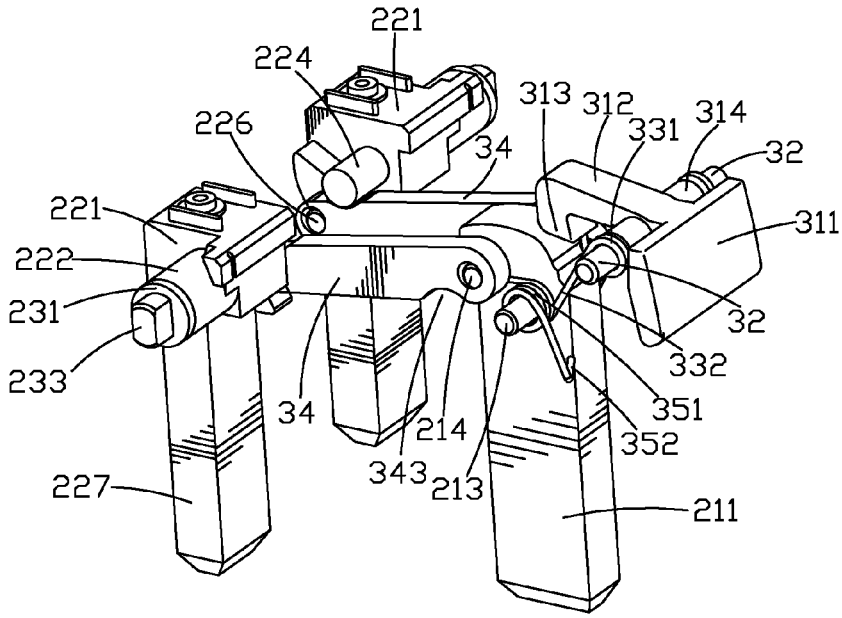
FIG. 4 is a perspective view showing a pin assembly and the driving module of the power supply adapter assembled together.
Figure 5:
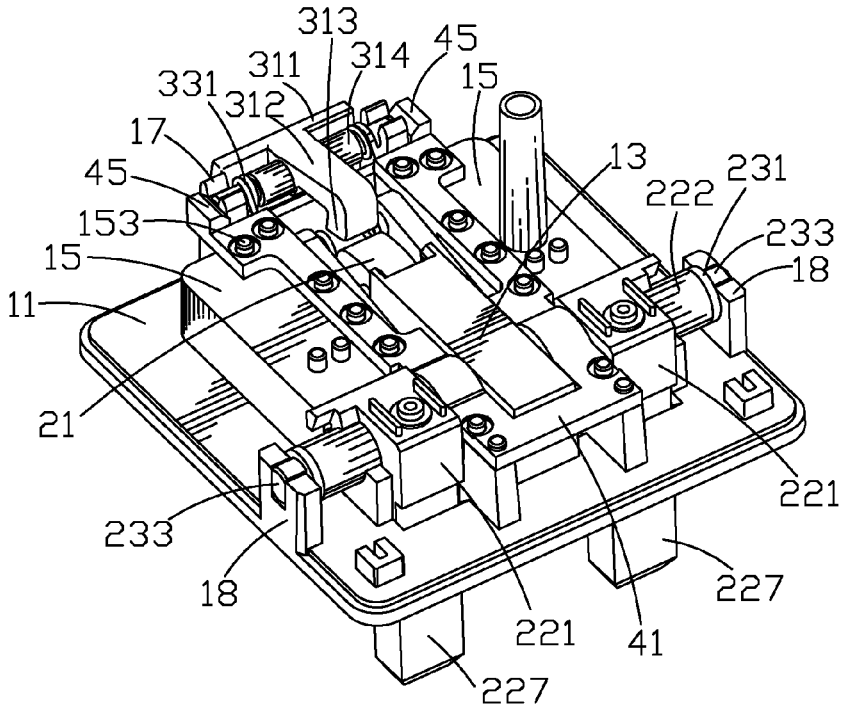
FIG. 5 is an assembly view of the power supply adapter without a shell.
Figure 6:
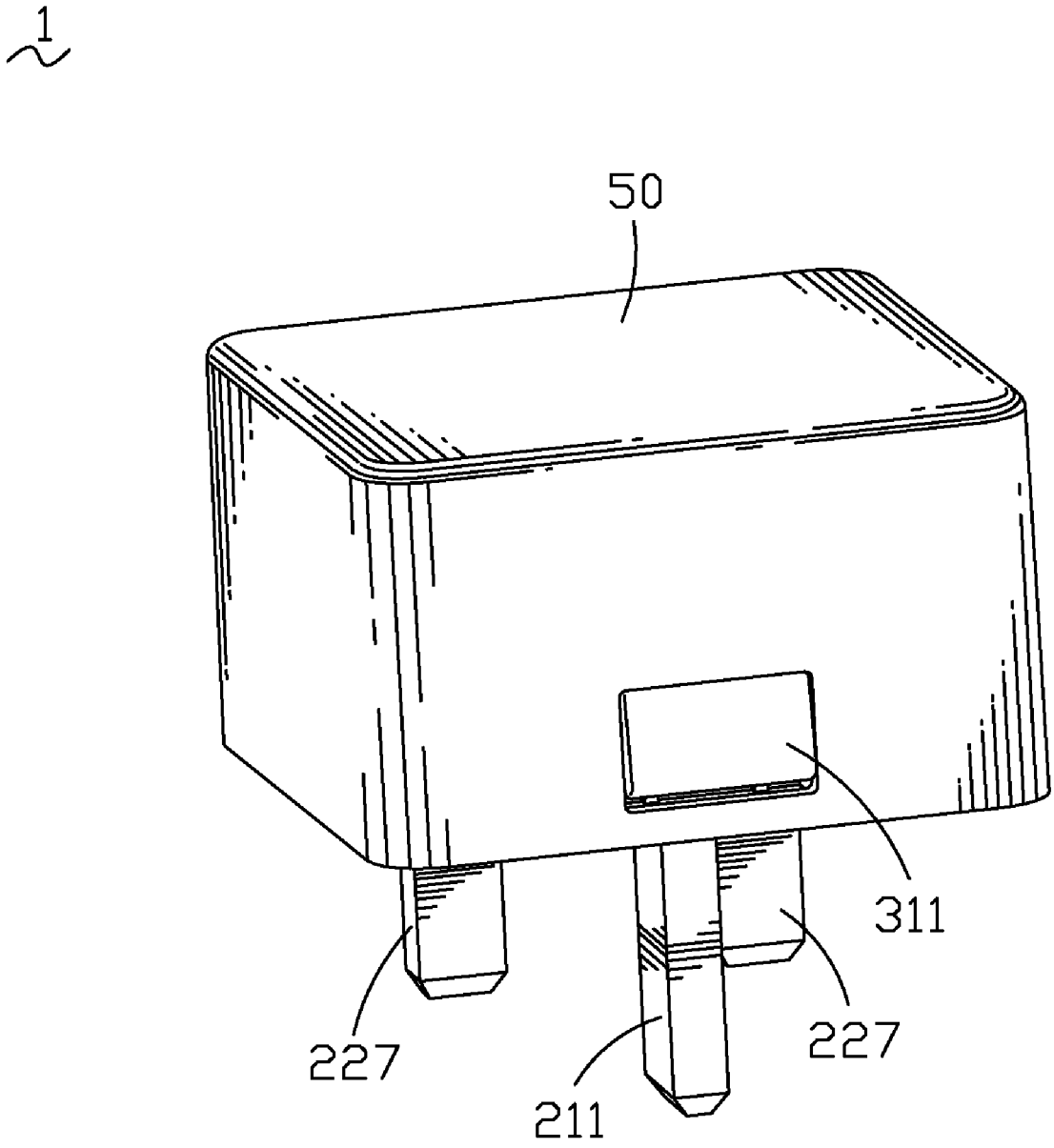
FIG. 6 is a perspective view of the power supply adapter of FIG. 1.

Referring to FIGS. 4-6, when the power supply adapter 1 is to be assembled, the second sleeving portion 351 of the second spring 35 is sleeved to the corresponding first pivoting shaft 213 of the first pin 21. The fastening ring 353 is sleeved to the corresponding first pivoting pillar 214. The first pivoting pillar 214 is further pivoted in the first pivoting aperture 341 of the respective connecting bar 34. The fastening ring 353 is located between the first blade 211 and the corresponding connecting bar 34. The second pivoting pillar 226 of the second pin 22 is pivoted in the corresponding second pivoting aperture 342 and the second pivoting shaft 224 can be partially received in the respective second receiving groove 344. The third pivoting shaft 232 of the locating element 23 is pivoted in the respective pivoting tube 222.

When the pin assembly 20 and the driving module 30 are assembled to the base frame 10, a free end of the first pivoting shaft 213 of the first pin 21 is pivoted in a bottom of the corresponding fastening fillister 152 and the second sleeving portion 351 of the second spring 35 is received in the corresponding first pivoting cavity 131. The propping part 352 of the second spring 35 is embedded in the base board 11. So the first blade 211 of the first pin 21 can be rotated rearward around the first pivoting shafts 213 into the first receiving recess 12 or be rotated forward out of the first receiving recess 12. The locating portion 225 and the pivoting tube 222 of the second pin 22 are respectively pivoted in the corresponding second pivoting cavities 151 of the second receiving casing 15 and the fastening portion 233 of the locating element 23 is fastened in the fastening cavity 181 of the respective fastening board 18. The propping slice 231 is clipped between the pivoting tube 222 and the corresponding fastening board 18. So the second blade 227 of the second pin 22 can be rotated forward around the second pivoting shaft 224 and the third pivoting shaft 232 into the corresponding second receiving recess 14 or be rotated rearward out of the corresponding second receiving recess 14. The connecting bar 34 is movably located between the first receiving casing 13 and the corresponding second receiving casing 15. The pivoting bar 32 is pivoted in the pivoting sleeves 314 of the control element 31 and two ends thereof stretch out of the respective pivoting sleeves 314. The two first sleeving portions 331 of the two first springs 33 are respectively sleeved to the two ends of the pivoting bar 32. The control element 31 is assembled in the front of the base frame 10 and the pressing portion 311 is located in front of and apart from the preventing board 16. The two ends of the pivoting bar 32 are respectively pivoted in the pivoting holes 171 of the corresponding supporting boards 17 and the first sleeving portion 331 of each first spring 33 is located between the pivoting sleeve 314 and the corresponding supporting board 17. One of the two propping poles 332 of the first spring 33 abuts against the rear of the pressing portion 311 and the other propping pole 332 is embedded in the preventing board 16. The propping portion 312 of the control element 31 overstrides the preventing board 16 to make the second fixing portion 313 adjacent to a front top of the first pin 21. So the second fixing portion 313 can move upwards or downwards by way of pressing or setting free the pressing portion 311.

When the fastening body 40 is assembled on the base frame 10, the fastening pillars 153 of the base frame 10 are respectively fastened in the corresponding fastening perforations 46 of the fastening body 40. The second pivoting shaft 224 is partially pivoted in the corresponding first fastening groove 421. The second fastening plate 44 is fastened in the fastening fillister 152 of the corresponding second receiving casing 15 and the free end of the first pivoting shaft 213 is partially pivoted in the corresponding second fastening groove 441. The two fastening blocks 45 respectively abut against the outside of the corresponding supporting boards 17 and clip the pivoting bar 32 therebetween. So the pin assembly 20 and the driving module 30 can be firmly assembled in the base frame 10 by way of the fastening body 40. The shell 50 is covered on the base frame 10 and the pressing portion 311 of the control element 31 is movably received in the receiving window 51 and slightly stretches out of the receiving window 51.

Figure 7:
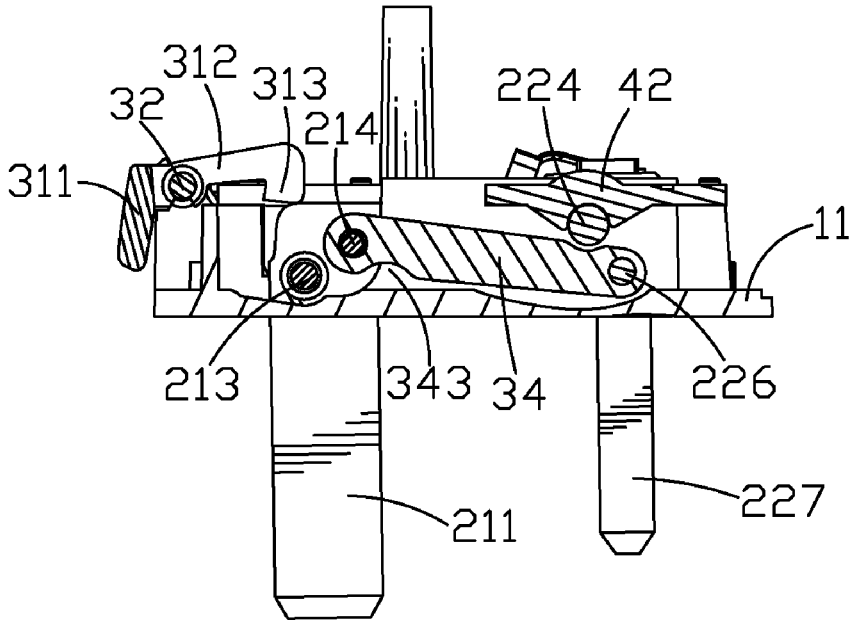
FIG. 7 is a cross-sectional view of the power supply adapter of which the pin assembly is located in a fully extended position.
Figure 8:
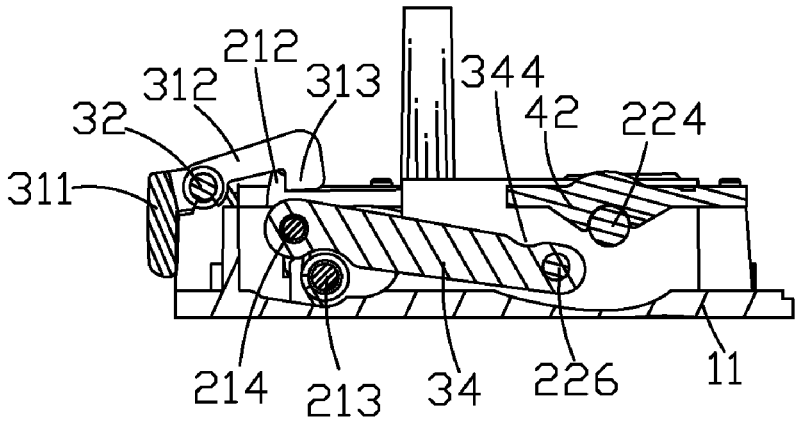
FIG. 8 is a cross-sectional view of the power supply adapter of which the pin assembly is located in a fully stowed position.

Referring to FIG. 7 and FIG. 8, when the power supply adapter 1 is not used, the first blade 211 of the first pin 21 is pushed rearward to rotate around the first pivoting shafts 213 so as to be received in the first receiving recess 12 of the first receiving casing 13. In this process, the first pivoting pillars 214 and the first fixing portion 212 simultaneously move toward the second fixing portion 313 of the control element 31, and the first pivoting pillar 214 further drives the corresponding connecting bar 34 to move forward. In the meanwhile, the connecting bar 34 drives the corresponding second pin 22 by means of the respective second pivoting pillar 226 to rotate forward around the second pivoting shaft 224 and the third pivoting shaft 232 of the locating element 23 so as to make the second blade 227 received in the second receiving recess 14 of the corresponding second receiving casing 15. When the first pin 21 is completely received in the first receiving recess 12, the second pins 22 are simultaneously received in the respective second receiving recesses 14 completely. At this time, the first fixing portion 212 of the first pin 21 is buckled with the second fixing portion 313 of the control element 31 so as to make the pin assembly 20 steadily stowed in the base frame 10. Furthermore, the second sleeving portion 351 of the second spring 35 is partially received in the first receiving groove 343 of the corresponding connecting bar 34.

When the power supply adapter 1 is to be used, press inward the pressing portion 311 to make the control element 31 rotate around the pivoting bar 32 so as to further drive the second fixing portion 313 to move upward in order for releasing the first fixing portion 212 of the first pin 21. When the second fixing portion 313 is completely departed from the first fixing portion 212, the first blade 211 of the first pin 21 is driven by the second springs 35 to rotate forward around the first pivoting shafts 213 so as to stretch out of the first receiving recess 12. In this process, the first pivoting pillar 214 drives the respective connecting bar 34 to move rearward and further to drive the second blade 227 of the corresponding second pin 22 by means of the second pivoting pillar 226 to rotate rearward around the second pivoting shaft 224 and the third pivoting shaft 232 so as to stretch out of the corresponding second receiving recess 14. When the first blade 211 and the second blade 227 are completely extended out of a bottom of the base frame 10 for being used, the second spring 35 is departed from the first receiving groove 343 of the corresponding connecting bar 34 while the second pivoting shaft 224 is partially received in the second receiving groove 344 of the corresponding connecting bar 34.

As described above, the power supply adapter 1 of the present invention utilizes a cooperation of the first fixing portion 212 of the first pin 21 and the second fixing portion 313 of the control element 31 by means of pushing the first blade 211 of the first pin 21 to facilitate the pin assembly 20 to be stowed in the base frame 10 or by means of pressing the pressing portion 311 of the control element 31 to facilitate the pin assembly 20 to be extended out of the base frame 10. Therefore, the driving module 30 has a relatively simple structure and occupies a relatively small space in the power supply adapter 1.

What is claimed is:

1. A power supply adapter, comprising:

a base frame;

a pin assembly having a first pin and at least one second pin respectively pivoted in the base frame, the first pin defining a first fixing portion;

a driving module having a control element and at least one connecting bar, the control element being pivoted on the base frame and having a pressing portion, a propping portion extended from the pressing portion and a second fixing portion protruding from a free end of the propping portion, the connecting bar being pivoted between the first pin and the second pin; and a shell covered on the base frame and defining a receiving window for receiving the pressing portion of the control element therein, the pressing portion partially stretching out of the receiving window;

wherein the second fixing portion of the control element is capable of being buckled with the first fixing portion of the first pin so as to secure the pin assembly in the base frame by way of pushing the first pin to drive the pin assembly by means of the connecting bar to rotate into the base frame, while the pressing portion of the control element can be pressed to make the second fixing portion release the first fixing portion so as to make the pin assembly extend out of the base frame.

2. The power supply adapter as claimed in claim 1, wherein the driving module further includes a pivoting bar and at least one first elastic element, the pivoting bar is pivoted to the control element and further pivoted to the base frame, the first elastic element is sleeved to the pivoting bar and has two propping poles, one of the two propping poles is embedded in the base frame and the other propping pole abuts against the pressing portion.

3. The power supply adapter as claimed in claim 2, wherein two sides of the propping portion of the control element protrude oppositely to form two pivoting sleeves adjacent to the pressing portion, the pivoting bar is pivoted in the pivoting sleeves.

4. The power supply adapter as claimed in claim 1, wherein the first pin has a first blade, the first fixing portion protrudes outward from one end of the first blade, two sides of the end of the first blade protrude oppositely to form a pair of first pivoting shafts pivoted in the base frame, at least one side of the end of the first blade further protrudes outward to form a first pivoting pillar, the driving module further includes at least one second elastic element sleeved to the corresponding first pivoting shaft, the second elastic element has a propping part embedded in the base frame and a fastening ring sleeved to the first pivoting pillar.

5. The power supply adapter as claimed in claim 4, wherein the second pin has a base block and a second blade having one end fixed in the base block, one side of the base block protrudes outward to form a second pivoting pillar and a second pivoting shaft pivoted in the base frame, two ends of the connecting bar respectively define a pivoting aperture, the first pivoting pillar of the first pin and the second pivoting pillar of the second pin are respectively pivoted in the corresponding pivoting apertures.

6. The power supply adapter as claimed in claim 5, wherein the other side of the base block of the second pin protrudes outward to form a cylindrical pivoting tube coaxial with the second pivoting shaft and pivoted in the base frame, the pin assembly further includes at least one locating element each having a disc-shaped propping slice, two opposite sides of the propping slice protrude oppositely to form a fastening portion and a third pivoting shaft, the fastening portion is fastened in the base frame and the third pivoting shaft is pivoted in the pivoting tube of the second pin.

7. The power supply adapter as claimed in claim 1, wherein the base frame has a base board, a hollow first receiving casing and at least one hollow second receiving casing paralleling each other are defined on the base board and each have a bottom passing through the base board, the first pin and the second pin are pivotally received in the first receiving casing and the second receiving casing respectively, the base board further protrudes upwards to form a preventing board facing one end of the first receiving casing, a pair of supporting boards are formed on the base board and connected at two ends of the preventing board, the control element is pivoted on the supporting boards, the pressing portion is located between the supporting boards and apart from an outside of the preventing board, the propping portion overstrides the preventing board to make the second fixing portion near to the first pin, the connecting bar is movably located between the first receiving casing and the second receiving casing.

8. The power supply adapter as claimed in claim 1, further comprising a fastening body fixed on the base frame for securing the pin assembly and the driving module in the base frame, the fastening body having a base plate and a pair of first fastening plates extending forward from two ends of the base plate, a bottom of each first fastening plate defining a first fastening groove for partially pivoting a corresponding part of the second pin therein, an inside of the first fastening plate protruding downwards to form a second fastening plate fastened in the base frame, a bottom of each second fastening plate defining a second fastening groove for partially pivoting a corresponding part of the first pin therein, a free end of each first fastening plate protruding forward to form a fastening block, the two fastening blocks securing the control element of the driving module therebetween.

9. The power supply adapter as claimed in claim 8, wherein the first fastening plate of the fastening body further defines a plurality of fastening perforations, the base frame has a plurality of fastening pillars respectively inserted in the corresponding fastening perforations.

* * * * *